US006648761B1

(12) United States Patent
Izawa et al.

(10) Patent No.: US 6,648,761 B1
(45) Date of Patent: Nov. 18, 2003

(54) METHOD AND APPARATUS FOR ISSUING COUPONS FOR A GAMING MACHINE

(75) Inventors: Hikaru Izawa, Osaka (JP); Yoshiaki Uemizo, Osaka (JP); Kensuke Matsunaga, Osaka (JP)

(73) Assignee: Japan Cash Machine Co., Ltd., Osaka (JP)

( * ) Notice: Subject to any disclaimer, the term of this patent is extended or adjusted under 35 U.S.C. 154(b) by 0 days.

(21) Appl. No.: 09/830,801

(22) PCT Filed: Aug. 31, 1999

(86) PCT No.: PCT/JP99/04715

§ 371 (c)(1),
(2), (4) Date: Jul. 9, 2001

(87) PCT Pub. No.: WO01/16888

PCT Pub. Date: Mar. 8, 2001

(51) Int. Cl.[7] ..... A63F 9/24
(52) U.S. Cl. ..... 463/25
(58) Field of Search ..... 463/25–28; 705/14

(56) References Cited

U.S. PATENT DOCUMENTS 4,704,518 A * 11/1987 Brunn et al. ..... 235/480
6,012,832 A * 1/2000 Saunders et al. ..... 235/375

FOREIGN PATENT DOCUMENTS

| | | |
|---|---|---|
| EP | 0 171 380 A1 | 2/1986 |
| EP | 0 473 137 A2 | 3/1992 |
| EP | 0 555 565 A1 | 8/1993 |
| WO | WO 94/16781 | 8/1994 |
| WO | WO 98/59311 | 12/1998 |

* cited by examiner

*Primary Examiner*—Andrew M. Dolinar
(74) *Attorney, Agent, or Firm*—Bachman & LaPointe, P.C.

(57) ABSTRACT

A coupon issuing apparatus for a gaming machine is provided which comprises a hopper 2 for containing a plurality of blank coupon, a conveyer means 20 for discharging a blank coupon from the hopper 2 and transporting the blank coupon along a passageway 14, and a printer 19 provided in the vicinity of the passageway 14 for printing given gaming information on the moving blank coupon to easily dispense valuable coupons at player's request by printing monetary value on the blank coupon by the printer 19.

10 Claims, 7 Drawing Sheets

METHOD AND APPARATUS FOR ISSUING COUPONS FOR A GAMING MACHINE

FIELD OF THE INVENTION

This invention relates to coupon issuing technology, in particular to method and apparatus for issuing coupons indicative of monetary value corresponding to an amount of prize money that a player has won in a gaming machine.

BACKGROUND OF THE TECHNOLOGY

When a player wins games with a gaming machine in a gambling establishment such as a casino, a bill dispenser connected with the gaming machine dispenses bills or currency corresponding to an amount of prize money that the player wins. However, in most cases, the bill dispenser runs short of bills contained therein and therefore fails to dispense the required amount of bills because it does not have its large capacity for storing plenty of bills to dispense. Typically, the bill dispenser is not so designed to have a bill recycling system wherein bills inserted into the gaming machine can be transported to and dispensed from a dispensing tray of the bill dispenser as prize money. Accordingly, plenty of bills must always be supplied to the bill dispenser to surely dispense the required amount of bills corresponding to prize money for the win games.

In another aspect, when bills are supplied to the bill dispenser, a clerk of the casino must do troublesome operations that comprises the steps of reserving plenty of bills; unlocking and opening a door of the gaming machine; removing a stacker from the bill dispenser in the gaming machine; unlocking the stacker; supplying plenty of bills in the stacker; locking and attaching the stacker in the bill dispenser; and closing and locking the door of the gaming machine. To this end, the casino must always reserve a vast number of bills in the bill dispensers, and give the thorough and strict security protection for bills against theft upon replenishment with bills of the bill dispenser in the gaming machines. To solve these problems, a proposal has been made that a bill dispenser in a casino can safely and easily pay out cashable tokens, coupons or scrip of a certain kind corresponding to the prize money of win games without using real bills.

For example, U.S. Pat. No. 5,290,033 to Harold G. Bittner et al. discloses a gaming machine which contains a vast number of game coupons each bearing a legend or prize code key printed on the front side. These game coupons are contained in coupon magazines for distribution, however no printer is provided in the gaming machine so that it cannot print a required monetary amount on the game coupons upon issuance. Also, International Publication No. WO 94/16781 shows a gaming apparatus which comprises a slot machine capable of accepting either paper currency preprinted coupons or cash out slips. The slot machine also includes a printer that prints and dispenses cash out slips which include a bar code representing a unique identification that provides the amount of "winnings". However, this printer is not used to prepare valuable coupons.

Thus, the known typical bill dispenser can provide a player with only a kind of bills or tokens so that it tends to lack in bills due to absence of large denomination bills or tokens in it, and therefore a clerk must always replenish a supply of bills or coupons at apparently dangerous work to carry bills or coupons to gaming machines and fill the bill dispenser up with them.

Accordingly, an object of the present invention is to provide method and apparatus for issuing coupons indicative of monetary value corresponding to an amount of prize money that a player has acquired in a gaming machine.

Another object of the invention is to provide method and apparatus for issuing valuable coupons for a gaming machine to prevent emission of improper or invalid coupons.

Still another object of the present invention is to provide method and apparatus for issuing coupons for and around a gaming machine.

A further object of the instant invention is to provide method and apparatus for promptly issuing coupons each which represents a corresponding monetary value printed thereon to an amount of prize money that a player wins in a gaming machine at player's request.

DISCLOSURE OF THE PRESENT INVENTION

Applied to a gaming machine (80) is the method for issuing coupons according to the present invention which comprises the steps of accumulating blank coupons in a hopper (2); forwarding an issue command from the gaming machine (80) to an issue control circuit (30); driving a conveyer means (20) by outputs from the issue control circuit (30) to draw a blank coupon from the hopper (2) to a passageway (14); transporting the blank coupon along the passageway (14) to a printing area (15) provided with a printer (19); activating the printer (19) by outputs from the issue control circuit (30) to print gaming information on the moving blank coupon and thereby prepare a valuable coupon; and dispensing the coupon from an outlet (23) of the passageway (14).

According to the present invention, the valuable coupon can easily be issued at player's request by printing monetary value on a blank coupon. Each valuable coupon may bear the printed information representing the monetary value corresponding to an amount of prize money that a player has gained in the gaming machine. The monetary values to be printed on the blank coupon may be different every win game the players have done so that the printer can print various monetary values on the coupon payable to the players without storage or supply of bills in the gaming machine.

In an embodiment of the present invention, the method may comprise converting by a transducer (18) the gaming information printed on the coupon into electrical signals; forwarding the signals from the transducer (18) to the issue control circuit (30); confirming in the issue control circuit (30) based on the signals from the transducer (18) whether the coupon is proper; dispensing the coupon from the outlet (23) of the passageway (14) after the issue control circuit (30) confirms that the coupon is proper; and preventing distribution of the coupon when the issue control circuit (30) decides that the coupon is improper.

The confirming process includes deciding that the proper coupon bears the correctly printed gaming information or is composed of a single sheet drawn from the hopper (2); or that the improper coupon includes the incorrectly printed gaming information or is composed of double sheets drawn from the hopper (2). After the preceding blank coupon is transferred to the printing area 15, extraction of a next blank coupon from the hopper (2) is barred.

The coupon is transferred from the printing area (15) to a stand-by area (16) where it temporarily is held for confirmation by the issue control circuit (30) on whether the coupon in the stand-by area (16) is proper. In this case, when the issue control circuit (30) confirms that the coupon is proper, it is carried from the stand-by area (16) through a pay-out area (17) to the outlet (23). Adversely, when the issue control circuit (30) decides the coupon as improper, it is conveyed from the stand-by area (16) to a reject chamber (28) for storage, and a new coupon preferably is reissued by outputs of the issue control circuit (30).

In the embodiment of the invention, a deflection device (25) is provided between the printing area (15) and stand-by area (16) at a junction of the printing area (15) and the pay-out area (17). The deflection device (25) is movable between a rest position for opening the printing area (15) and closing the pay-out area (17), and a shift position for closing the printing area (15) and opening the pay-out area (17). When the moving coupon passes through the deflection device (25), a leading edge of the moving coupon forcibly pushes a deflector (26) of the deflection device (25) from the rest position to the shift position. The method according to the invention may comprise cutting a continuous paper into a card-like or sheet-like blank coupon of given length by a cutter means (60) on the passageway (14). The gaming information includes at least monetary value corresponding to an amount of prize money that a player won in the gaming machine (80) as well as an issue serial number inherent or peculiar to the local gaming machine (80) or visible and bar coded information. Information printed on the valuable coupon may involve visible information for confirmation by a player with bar coded information, and the gaming machine has a bill validator disclosed for example in U.S. Pat. No. 5,381,019 to Taichi Sato or U.S. Pat. No. 5,420,406 to Hikaru Izawa et al. When a player inserts the valuable coupon, the bill validator can decode the bar coded information on the coupon to start or continue playing game, effectively operating the gaming machine (80).

The coupon issuing apparatus for a gaming machine (80) according to the present invention comprises a hopper (2) for containing a plurality of blank coupons; a conveyer means (20) for drawing a blank coupon out of the hopper (2) and transporting the blank coupon or printed coupon along a passageway (14) for distribution from an outlet (23) provided at the end of the passageway (14); a printer (19) mounted in the vicinity of the passageway (14) for printing gaming information on the moving blank coupon to produce a valuable coupon; and an issue control circuit (30) for controlling operation of the conveyer means (20) and the printer (19) in response to an issue command of the gaming machine (80).

Upon receiving an issue command from the gaming machine (80), the issue control circuit (30) operates the conveyer means (20) which draws a blank coupon from the hopper (2) and transports it along the passageway (14). The issue control circuit (30) supplies the printer (19) with gaming information including monetary value corresponding to an amount of prize money that a player has gained in a gaming machine; a symbol; and an issue serial number inherent to the local gaming machine (80) to easily discriminate authenticity of the coupon by the bill validator. Also, the printer (19) is activated by outputs of the issue control circuit (30) to print on the moving blank coupon these information stored in the gaming machine (80) so that the blank coupon is matured into a valuable coupon which is subsequently dispensed from the outlet (23) provided at the end of the passageway (14) without need of distributing plenty of real money.

According to the embodiment of the invention, the coupon issuing apparatus may further comprise a transducer (18) disposed along the passageway (14) at the downstream of the printer (19) for converting the gaming information printed on the coupon into electrical signals and transmitting the signals to the issue control circuit (30), and a reject chamber (28) connected to the passageway (14) so that the issue control circuit (30) operates the conveyer means (20) to forward the coupon to the reject chamber (28) when the circuit (30) decides the coupon as improper.

The issue control circuit (30) decides that the proper coupon bears the correctly printed gaming information or is composed of a single sheet drawn from the hopper (2); or that the improper coupon includes the incorrectly printed gaming information or is composed of double sheets drawn from the hopper (2). The issue control circuit (30) reissues a new coupon when the circuit (30) detects the improper coupon which is transported to the reject chamber (28) by the conveyer means (20).

The passageway (14) may comprise a printing area (15) provided with the printer (19) and communicated with the hopper (2); a stand-by area (16) communicated between to the printing area (15) and the reject chamber (28) for temporarily holding the printed coupon; and a pay-out area (17) communicated between the stand-by area (16) and the outlet (23).

The deflection device (25) comprises a deflector (26) rotatably attached between the rest position and the shift position, and a return spring (27) for resiliently urging the deflector (26) toward the rest position. The deflector (26) is rotated from the rest to the shift position against elastic force of the return spring (27) by a leading edge of the coupon moving from the printing area (15) to the stand-by area (16). The deflector (26) is retained in the shift position by elastic force of the return spring (27) before and after the coupon is moved from the stand-by area (16) to the pay-out area (17).

Accordingly, the movement of the deflection device (25) causes the coupon to smoothly and surely be transported from the printing area (15) to the stand-by area (16) or from the stand-by area (16) to the pay-out area (17). Moreover, the deflection device (25) does not need any electrically-operated actuator because the deflector (26) can be moved from the rest to the shift position by the moving coupon and automatically returned to the rest position by elastic force of the spring (26).

The transducer (18) comprises an optical sensor or a magnetic sensor for optically or magnetically detecting bar coded information on the coupon. The coupon issuing apparatus is conveniently disposed in the gaming machine (80) because a player can receive there a coupon immediately dispensed from the coupon issuing apparatus in the gaming machine (80). Otherwise, the coupon issuing apparatus may be disposed outside the gaming machine (80).

The hopper (2) comprises a cassette (4) removably attached to the coupon issuing apparatus for accumulating blank coupons. The conveyer means (20) comprises pull rollers (7, 8) rotatably mounted under the cassette (4) for pulling the blank coupon out of the cassette (4) to the printing area (15); and an idle roller (9) mounted at the downstream of the pull rollers (7, 8) for conveying the coupon from the printing area (15) to the stand-by area (16) in cooperation with a plurality of drive rollers (10 to 13). The pull rollers (7, 8) can transport not only the blank coupon through the printing area (15) but also the coupon through the stand-by area (16) for simplified structure of the conveyer means (20). The reject chamber (28) preferably is formed under the cassette (4) at the end of the stand-by area (16) to convey an improper coupon to the reject chamber (28). In lieu of separate blank coupons contained in the cassette (4), a cutter means (60) and a roll of a continuously wound paper may be provided along the passageway (14)

for cutting the continuous paper into a card-like or sheet-like blank coupon of given length. A surface of the coupon bears the printed information readable by a bill validator to cash the coupon by an exchanger provided in the gaming machine (80) or to operate the gaming machine (80).

The conveyer means (20) comprises at least a pull roller (7, 8) in contact to a lowermost blank coupon in the cassette (4) for drawing it out of the cassette (4); and a transport roller (6) for transporting the blank coupon received from the pull roller (7, 8) to the printing area 15. An electromagnetic clutch device (47) is provided to stop rotation of the transport roller (6) to bar extraction of a next blank coupon from the hopper (2) after the preceding blank coupon is transferred to the printing area 15. To this end, the electromagnetic clutch device (47) comprises a drive gear (37) mounted on a clutch shaft (42) for free rotation; a clutch plate (40) sidably mounted between the active and inactive positions on the clutch shaft (42) for supporting the transport roller (6); and an actuator (43) for urging the clutch plate (40) in the inactive position to the active position to bring the clutch plate (40) into detachable engagement with the drive gear (37). The electromagnetic clutch device (47) comprises a release spring (39) for elastically urging the clutch plate (40) toward the inactive position, and the actuator (43) pushes the clutch plate (40) toward the active position against elastic force of the release spring (39). 32. The bar coded information includes the monetary value, BET number and serial number and symbol.

The above-mentioned as well as other objects of the present invention will become apparent during the course of the following detailed description and appended claims.

BEST MODE FOR EMBODIMENT OF THE INVENTION

Referring to FIGS. 1 to 10, embodiments of the present invention are described hereinafter.

Figure 1:
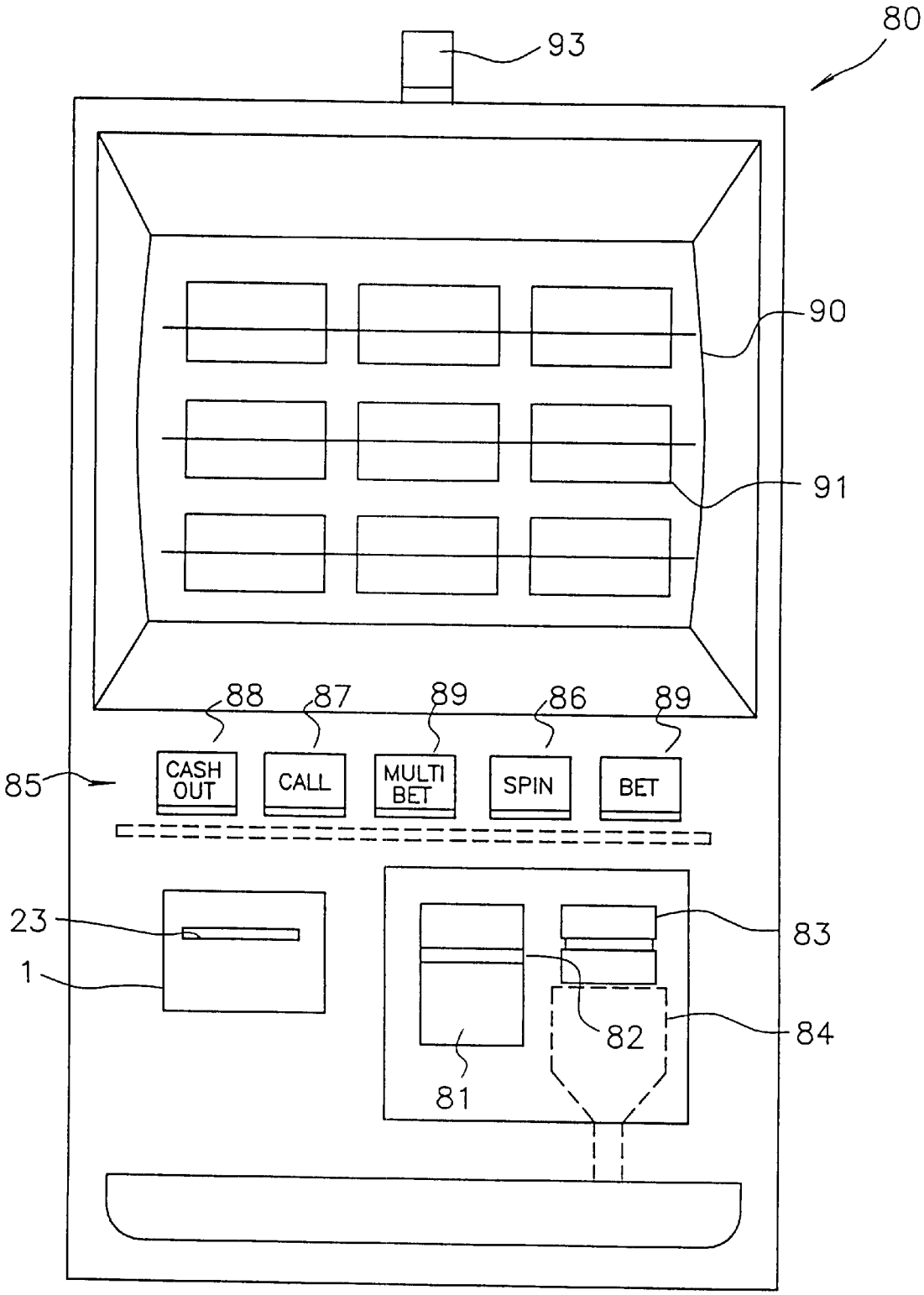
FIG. 1 is a front view of a gaming machine provided with a coupon issuing apparatus according to the present invention.

FIG. 1 shows an exemplary form of an electronic slot or gaming machine 80 equipped with a coupon issuing apparatus 1 according to the present invention. Like slot machines generally, the gaming machine 80 collects money, initiates game play, illustrates game play and provides a payout for successful game play. The gaming machine 80 includes a bill validator 81 provided to accept money and coupons in a slot 82 in the form of bills of various denominations.

The bill validator 81 pulls in paper currency, bank notes, bills or coupons, determines the denomination of the bills or coupons and determines whether the bills or coupons are valid. If a bill or coupon is invalid, it will be ejected by the bill validator 81 and thus returned to the player through the slot 82. If a valid bill or coupon is inserted into the slot 82, the bill validator 81 will retain them and communicate their acceptance to a game controller (not shown) of a microprocessor within the gaming machine 80.

In addition, the gaming machine 80 includes a coin acceptor 83 and coin hopper 84 (shown schematically) which accepts and collects coins, count coins, validates coins and stores coins. The coin acceptor 83 is electrically communicated to the game controller to provide the controller with information concerning the amount and validity of coins ascertained by the coin acceptor 83. As an alternative, the bill validator 81 can be configured to accept coded coupons issued by the coupon issuing apparatus or casino's other machines to allow a player to obtain credits on the gaming machine 80 without depositing either currency or coins.

If sufficient bills, coins or coupons have been inserted into the gaming machine 80, the game controller will allow game play to be initiated, and the player will push a "PLAY" or "SPIN" button 86 located on the button panel 85 of the gaming machine 80 and enabled by the game controller. This "SPIN" button 86 serves as an initiate play switch to allow the player to initiate game play simply by pressing it. The gaming machine 80 may alternatively, or in addition, include a handle (not shown) which the player pulls to initiate play.

Additionally the button panel 85 may have a CALL button 87, CASH OUT button 88 and MULTIPLE BET button 89 to allow the player to call the attendant, dispense a coupon indicating the monetary value of accumulated winnings or make multiple bets before initiating game play. These additional buttons 87, 88, 89 are also linked to and controlled by the game controller and lit during game play, particularly when their functions are available for activation by the player.

The gaming machine also features a display 90 such as a video display which may include one or more rows of display boxes 91 to indicate the results of each play. Further, a coupon is dispensed from the outlet 23 of the coupon issuing apparatus 1 upon a winning play, or when the player decides to cash out by pressing the CASH OUT button 88. In order to stimulate game play and generate excitement, the gaming machine 80 preferably also includes a lamp and sound generator 93 activated by the game controller.

Figure 2:
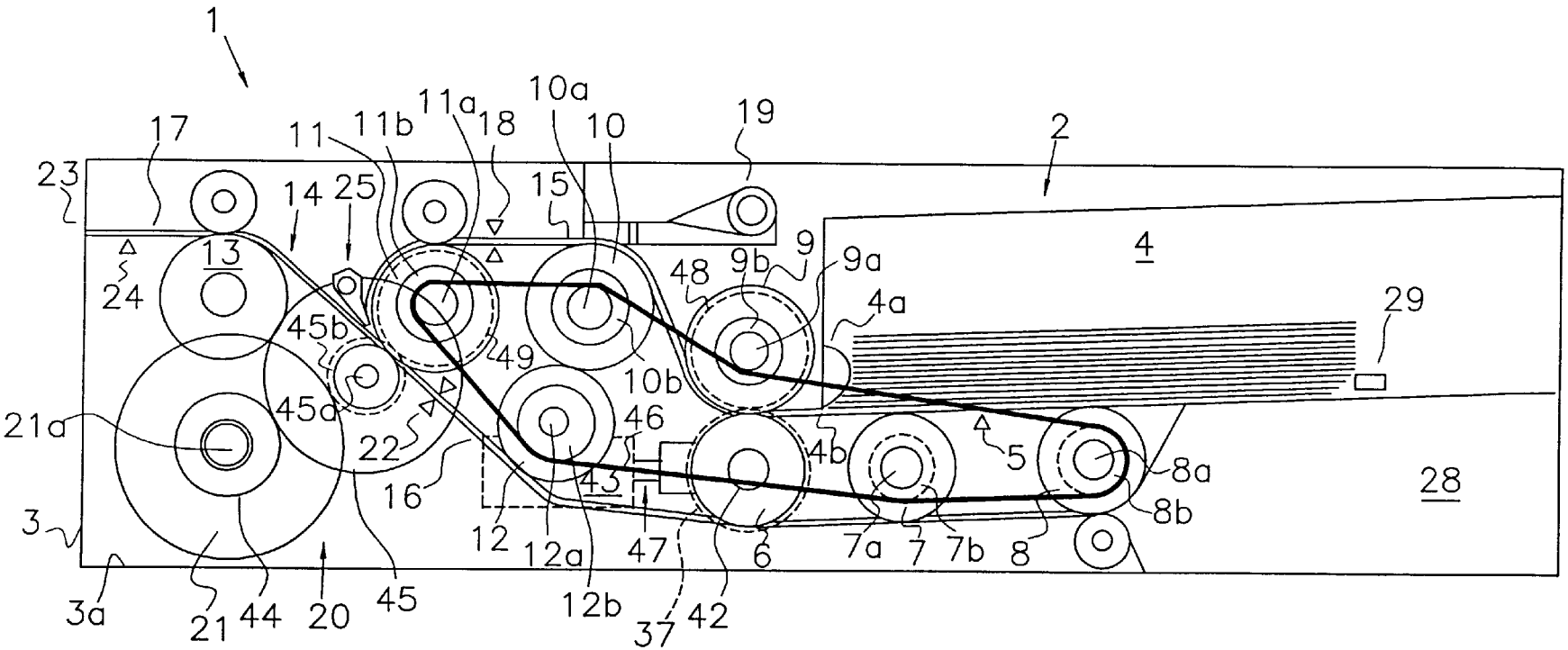
FIG. 2 is a cross-sectional view of the coupon issuing apparatus.

As shown in FIG. 2, the coupon issuing apparatus 1 according to the present invention comprises a hopper 2 which contains a plurality of unprinted blank coupon, and a conveyer means 20 which draws blank coupons out of the hopper 2 and transports them along a passageway 14. The hopper 2 comprises a cassette 4 removably attached to the apparatus 1 to contain the accumulated blank coupons; a stack sensor 5 to detect existence of blank coupons in the cassette 4; and a consumption sensor 29 provided in the hopper 2 to detect the remaining number of coupons less than a given number. A pad 4*a* with the curved surface is provided on an inner front surface of the cassette 4 adjacent to an exit slit 4*b* so that the curved surface of the pad 4*a* causes to locate each leadingedge of blank coupons accumulated at the lower portion in the shifted condition of these leading edges slightly slipped rearward along the curved surface of the pad 4*a* in order to prevent emission of stuck double sheets or a lump of sheets. The coupon issuing apparatus 1 is conveniently mounted in or away from the gaming machine 80 in electric bilateral communication wiht the coupon issuing apparatus 1.

The conveyer means 20 is formed with the passageway 14 to guide a transported coupon, a conveyer motor 21 disposed on the bottom 3*a* of a frame 3 for driving the conveyer means 20, a plurality of drive rollers 10 to 13 operatively connected with the conveyer motor 20 through reduction gears not shown, pull rollers 7, 8 rotatably attached under the cassette 4 in a contact relation to the lowermost blank coupon in the cassette 4, and a transport roller 6 and an idle roller 9 in a contact relation to each other at the downstream of the pull rollers 7, 8. Rotation shafts 7*a*, 8*a* respectively support the pull rollers 7, 8 for integral rotation, and are connected through the reduction gears and a drive belt 46 with the conveyer motor 20.

As shown in FIG. 2, provided in the vicinity of the transport roller 6 is an electromagnetic clutch device 47 which comprises a solenoid or actuator 43 with a movable plunger 43; a drive gear 37 mounted for free rotation on a clutch shaft 42; an operation arm 41 rotatably mounted on a shaft 45 and connected with the plunger 43 through a pin 43*b*; a hat-like clutch plate 40 mounted on the clutch shaft 42 of the transport roller 6; a spring seat 38 fixed on the clutch shaft 42; and a release spring 39 positioned between the spring seat 38 and clutch plate 40. Formed with the clutch plate 40 are protrusions 40*a* which may be detachably engaged with arcuate recesses 37*a* of the drive gear 37 by operation of the solenoid 43. Specifically, when the solenold 43 is activated by outputs of the issue control circuit 30, it pulls the plunger 43 so that the operation arm 41 is rotated in a counterclockwise direction in FIG. 4. Accordingly, the clutch plate 40 in the inactive position shown in FIG. 4 is moved along the clutch shaft 42 toward the active position shown in FIG. 3 against elastic force of the release spring 39 and the protrusions 40*a* of the clutch plate 40 are brought into engagement with the arcuate recesses 37*a* for integral rotation of the drive gear 37, clutch plate 40 and clutch shaft 42 as shown in FIG. 5. To this end, the clutch plate 40 is mounted on the clutch shaft 42 through a splined coupling wherein the clutch plate 40 is sidable in the axial direction on the clutch shaft 42 and also is rotatable together with the clutch shaft 42 supporting the transport roller 6. When the solenoid 43 is deactivated, the release spring 39 urges the clutch plate 40 toward the inactive position away from the drive gear 37 as shown in FIG. 4 to release the engagement of the protrusions 40*a* of the clutch plate 40 with the arcuate recesses 37*a* of the drive gear 37. Accordingly, the operation arm 41 is adversely rotated in the clockwise direction from the active position shown in FIG. 3 to the inactive position shown in FIG. 4 drawing the plunger 43 from the solenoid 43. In this way, the electromagnetic clutch device 47 can selectively stop rotation of the clutch shaft 42 by disengagement of the clutch plate 40 from the drive gear 37.

The passageway 14 comprises a printing area 15 for communication with the hopper 2, a stand-by area 16 connected between the printing area 15 and the reject chamber 28 for temporarily keeping the printed coupon, and a pay-out area 17 connected between the stand-by area 16 and the outlet 23 provided at the end of the passageway 14. The pull rollers 7, 8 are effective to convey the blank coupon through the printing area 15 and also the printed coupon through the stand-by area 16 for simplified structure of the conveyer means 20.

The printing area 15 includes a printer 19 for printing given gaming information on the moving blank coupon; and a transducer 18 disposed along the passageway 14 at the downstream of the printer 19 for converting the gaming information printed on the coupon into electrical signals. The printer 19 preferably is of a direct thermal printer with the thermal head for heating a surface of blank coupon for color printing. The transducer 18 may comprise an optical sensor of a light emitting element and a photodetector respectively mounted on the lower and upper sides of the passageway 14 to detect light emitted from the light emitting element and penetrated through the coupon or reflected on a surface of the coupon. The photodetector converts the optical features on or through the coupon into electrical signals and forwards them to the issue control circuit 30 (FIG. 8) to optically discriminate the properness of the printed coupon. The photodetector is available to sense an amount of the penetrated light through the coupon so that the issue control circuit 30 can detect if the coupon includes a plurality of stuck sheets in view of outputs of the photodetector. Alternatively or together with the optical sensor, the transducer 18 may comprise a magnetic sensor for detection of magnetic pattern and bar code printed on the coupon with ferrous ink.

The motor 21 of the conveyer means 20 has its drive shaft 21*a* with a pinion 44 secured thereon. Meshed with the pinion 44 is an intermediate gear 45 which has a shaft 45*a* to coaxially support a gear 45*b* for engagement with a main gear 49. The drive roller 11 has a shaft 11*a* on which the main gear 49 and a pulley 11*b* are mounted. The drive rollers 10 and 12 have respectively shafts 10*a* and 12*a* on which pulleys 10*b* and 12*b* are mounted. The idle roller 9 has a shaft 9*a* on which a middle gear 48 and a pulley 9*b* are mounted. The idle roller 9 is supported on the shaft 9*a* for free rotation, but the pulley 9*b* is secured to the shaft 9*a* for united rotation. The pull 7 rollers 7 and 8 have respectively shafts 7*a* and 8*a* on which pulleys 7*b* and 8*b* are mounted. The drive belt 46 is wound around the pulleys 7*b* to 12*b* to drive these rollers 7 to 12 in their synchronized relation. Accordingly, the drive belt 46 is rotated in the forward or adverse direction in response to rotation of the motor 21 in the forward or adverse direction, and simultaneously the rollers 7 to 12, middle gear 48 and drive gear 37 are rotated.

Figure 6:
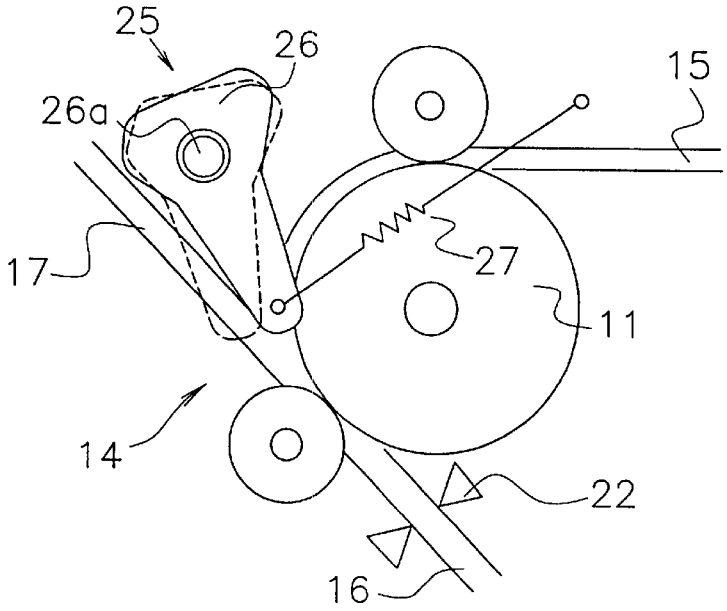
FIG. 6 is a cross-sectional view of a deflection device used in the coupon issuing apparatus.

A deflection device 25 is equipped with a deflector 26 provided at a junction of the printing area 15 and the pay-out area 17, and the deflector 26 is rotatably mounted around a shaft 26a between a rest position shown by solid line in FIG. 6 and a shift position shown by dotted line in FIG. 6. In the rest position, the deflector 26 closes the printing area 15 for the stand-by area 16, but opens the stand-by area 16 to the pay-out area 17. In the shift position, the deflector 26 opens the printing area 15 to the stand-by area 16, but closes the stand-by area 16 for the pay-out area 17. The deflection device 25 has a return spring 27 to resiliently urge the deflector 26 toward the rest position. An end detection sensor 22 is provided in the vicinity of the stand-by area 16 to detect passage of the coupon's rear end through the deflector 26 of the deflection device 25 to the stand-by area 16. Also, an outlet sensor 24 is provided in the vicinity of the pay-out area 17 to detect movement of the coupon to the outlet 23 of the pay-out area 17. When the coupon passes through the outlet sensor 24 and the leading edge of the coupon is partially extruded out of the outlet 23, the conveyer means 20 is stopped. Accordingly, the outlet sensor 24 can detect the subsequent pulling out of the coupon retained at the outlet 23 by a player.

Figure 7:
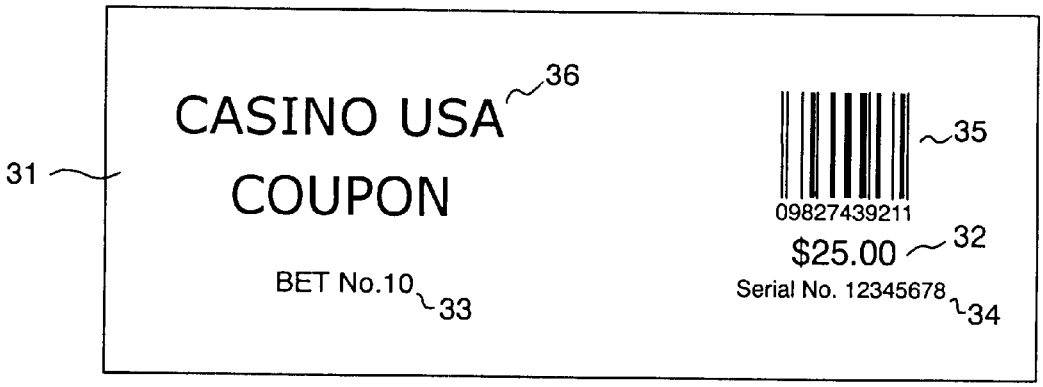
FIG. 7 is a plan view of a coupon dispensed from the coupon issuing apparatus.

FIG. 7 shows a typical example of the coupon issued from the coupon issuing apparatus according to this invention. A surface of the coupon 31 bears printed indications of a monetary value 32 corresponding to an amount of prize money for the win game; a BET number 33; a serial number 34 of the coupon 31 inherent to the local gaming machine 80; and a bar code 35 and a symbol 36 inherent or particular to the local gaming machine 80. Information represented by the bar code 35 includes these monetary value 32, BET number 33 and serial number 34 and symbol 36. The serial number 34 and symbol 36 are effective to exactly collate gaming information stored in the host computer of the gaming machines 80 with the printed gaming information on the coupon for accurate discrimination of the coupon's authenticity by the bill validator or for correct cashing by an exchanger of the gaming machine 80.

Figure 8:
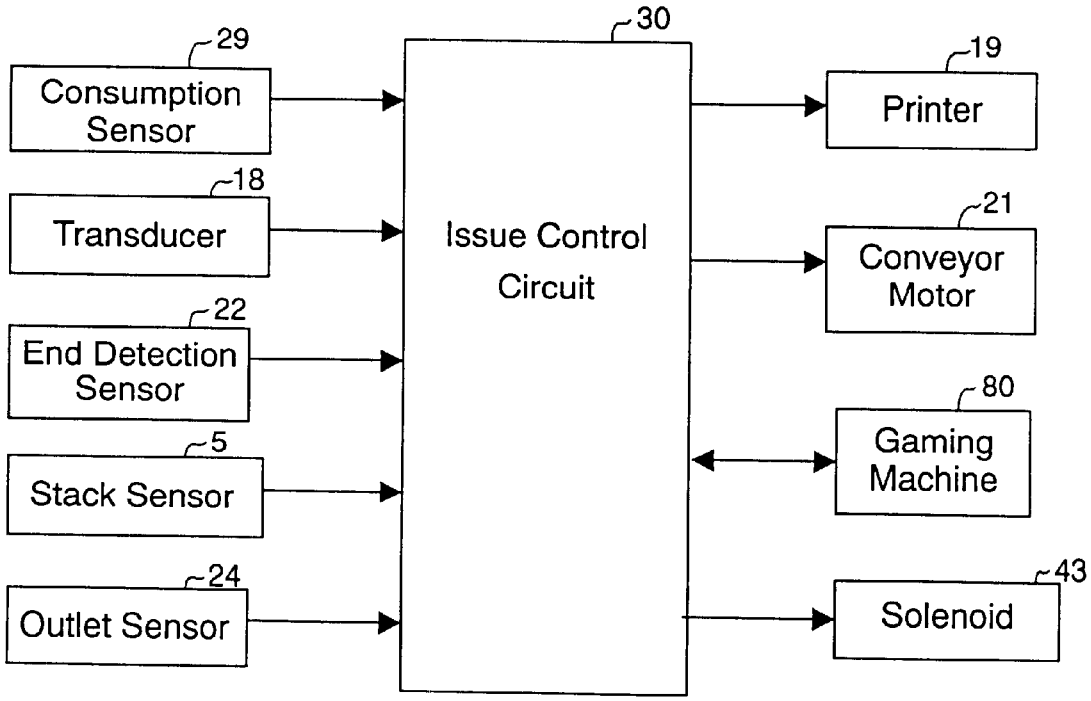
FIG. 8 is a block diagram indicating an electrical circuit of the coupon issuing apparatus.

FIG. 8 shows an electric circuit of the coupon issuing apparatus according to the present invention applied to the gaming machine 80. The electric circuit includes an issue control circuit 30 whose input terminals are connected with the stack sensor 5, consumption sensor 29, transducer 18, end detection sensor 22, and outlet sensor 24. The conveyer motor 21 and printer 19 are connected with output terminals of the issue control circuit 30 which is also in electrically bilateral communication with the gaming machine 80 so that the issue control circuit 30 can receive an issue command from the gaming machine 80 and forward outputs to the gaming machine 80 to inform current status of the coupon issuing apparatus 1.

Figure 9:
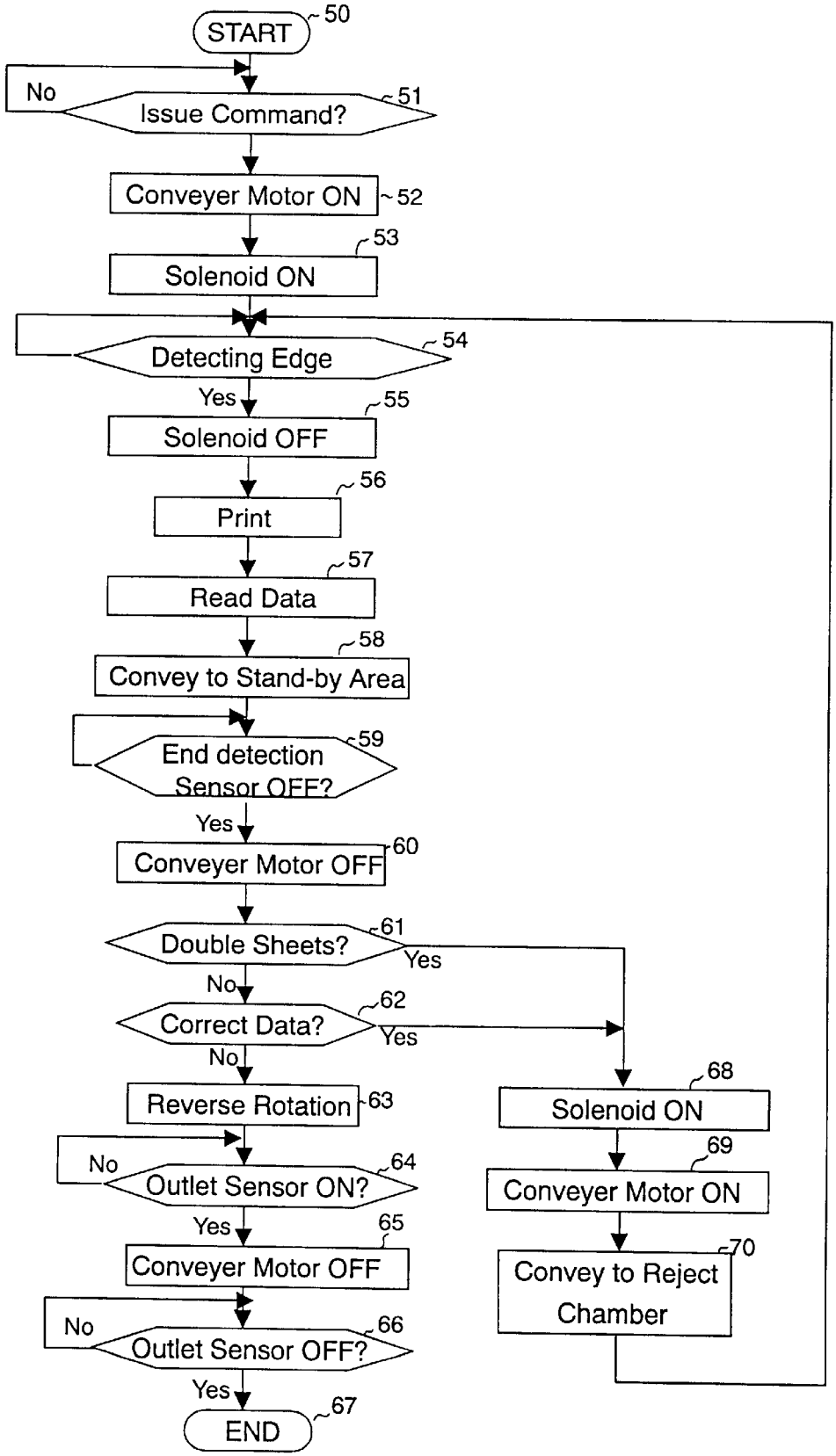
FIG. 9 is a flow chart indicating an operational sequence to dispense a coupon.

FIG. 9 shows an operational sequence of the coupon issuing apparatus 1 operated in cooperation with the gaming machine 80. In operation, a processing moves from Step 50 "START" to Step 51 where the issue control circuit 30 is awaiting an issue command from the gaming machine 80. When the player wins games in the gaming machine 80 and operates an exchange switch or CASH OUT button 88 provided on the gaming machine 80, it generates an issue command to the issue control circuit 30 which produces drive signals to the conveyer motor 21 to rotate the drive belt 46 in Step 52. Simultaneously, in Step 53, the issue control circuit 30 provides the solenoid 43 with a drive signal to rotate the operation arm 41 from the inactive position shown in FIG. 4 to the active position shown in FIG. 3 so that the protrusions 40*a* of the clutch plate 40 are brought into engagement with the arcuate recesses 37*a* of the drive gear 37 for united rotation of the drive gear 37 and clutch shaft 42 through the clutch plate 40. Accordingly, the pull rollers 7, 8 draws a lowermost blank coupon disposed at the bottom of the hopper 2 between the transport roller 6 and idle roller 9 so that the blank coupon is moved by the rotating transport roller 6 through the drive roller 10 to the printing area 15.

Figure 3:
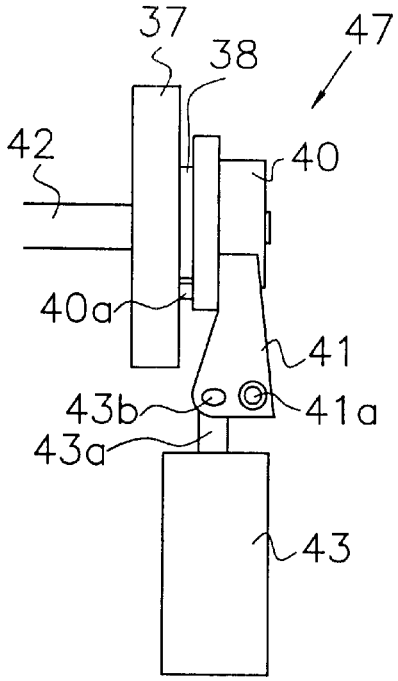
FIG. 3 is a side elevation view of an electromagnetic clutch device in the active position in the coupon issuing apparatus.
Figure 4:
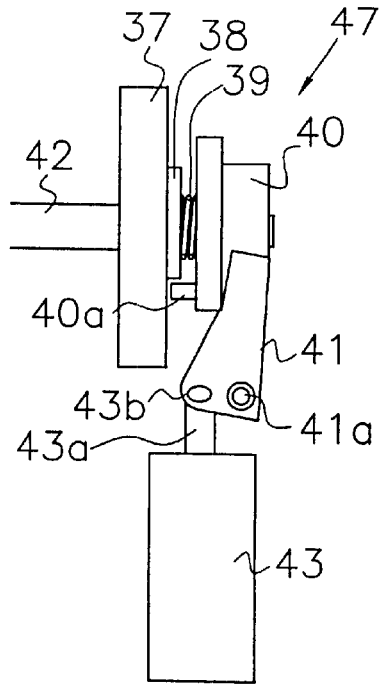
FIG. 4 is a side elevation view of the electromagnetic clutch device in the inactive position.
Figure 5:
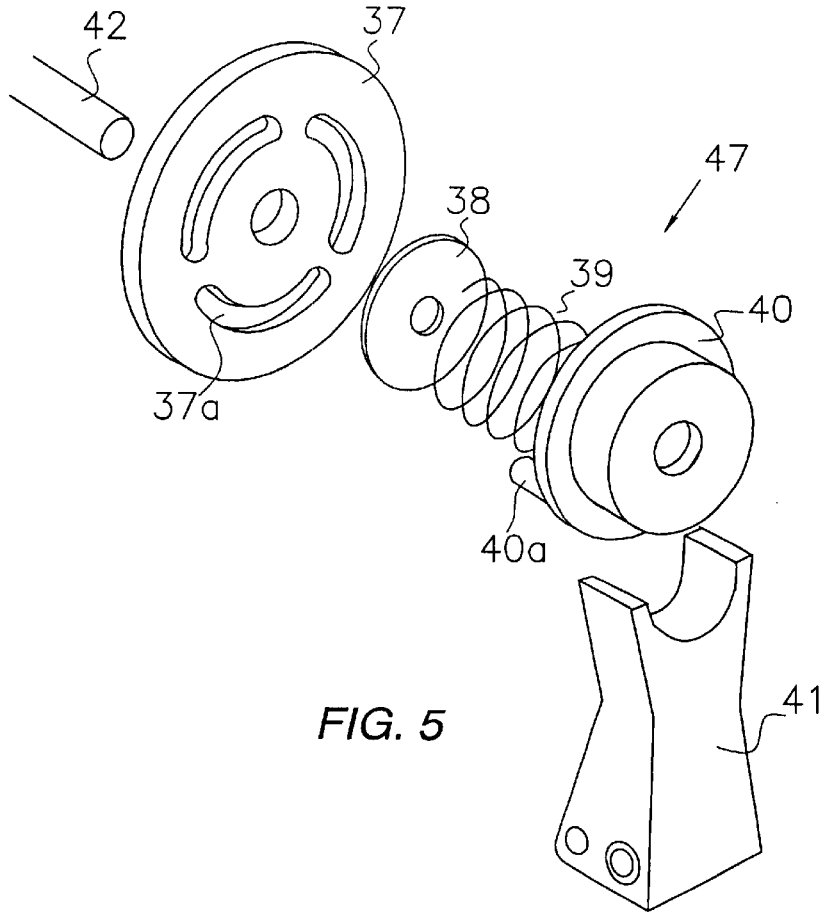
FIG. 5 is an exploded perspective view of the electromagnetic clutch device.

When an optical sensor provided in the transducer 18 detects the leading edge of the blank coupon in Step 54; the issue control circuit 30 ceases to produce the drive signal to the solenoid 43 to turn it OFF in Step 55, and therefore the operation arm 41 is rotated from the active position shown in FIG. 3 to the inactive position shown in FIG. 4. In this case, while the drive gear 37 is rotated around the clutch shaft 42 by the rotating drive belt 46 through the middle gear 48, the clutch plate 40 and clutch shaft 42 do not rotate due to disengagement of the protrusions 40*a* from the arcuate recesses 37*a*. In other words, the drive gear 37 is raced or idled around the clutch shaft 42, and the transport roller 6 and idle roller 9 remain stationary. A subsequent lowermost blank coupon is drawn from the cassette 4 by the rotating pull rollers 7, 8 and the leading edge of the blank coupon comes into contact with the stationary transport or idle roller 6 or 9 which effectively bars extraction and movement of this subsequent blank coupon from the cassette 4.

Then, in Step 56, the issue control circuit 30 forwards drive signals to the printer 19 to print necessary indications as shown in FIG. 7 on the blank coupon without change in moving rate of the blank coupon by the conveyer means 20. The printing process by the printer 19 produces a printed valuable coupon bearing visible in formation for the gaming machine 80 such as monetary value 32 corresponding to an amount of prize money for the win game, BET number 33, serial number 34 of the coupon 31 inherent to the local gaming machine 80 and bar code 35. Thus, the coupon issuing apparatus 1 can promptly print the necessary items on the blank coupon to dispense only a sheet of coupon without storage of bills or frequent supply of blank coupons for distribution. In Step 57, the transducer 18 reads out all of the indications including the bar code 35 printed on the moving coupon so that the issue control circuit 30 decodes and decides from the information read by the transducer 18 whether the coupon bears the correctly printed indications or is a single sheet.

Then, the coupon is carried from the printing area 15 toward the stand-by area 16 through the deflection device 25 in Step 58, while the leading edge of the coupon pushes the deflector 26 so that it moves from the rest position to the shift position respectively shown by solid and dotted lines of FIG. 6 against elastic force of the return spring 27. When the end detection sensor 22 detects the passage of the coupon's rear end which has overridden the deflector 26, it generates a detection signal in Step 59 to the issue control circuit 30 which then ceases drive signals to the conveyer motor 21 in Step 60 to stop the conveyer means 20. At this moment, the coupon remains stationary and temporarily stays in the stand-by area 16 until the issue control circuit 30 decides whether it is a proper coupon to be dispensed from the outlet 23 through the pay-out area 17 or an improper coupon to be transported to the reject chamber 28 for storage.

Receiving detection signals picked up by the transducer 18 in Step 57, the issue control circuit 30 decides in Step 61 whether the coupon is a single sheet. In case of the single sheet, the circuit 30 then determines in Step 62 whether the coupon bears the correctly printed gaming information on the surface. In case of the correct printed gaming information, the issue control circuit 30 drives the conveyer motor 21 to rotate in the adverse direction in Step 63 and transport the coupon from the stand-by area 16 to the pay-out area 17 so that a leading edge of the coupon is ejected from the outlet 23 for dispensation. When the outlet sensor 24 is turned ON by the coupon in Step 64, the issue control circuit 30 stops the conveyer motor 21 in Step 65 so that the major portion of the coupon is in the pay-out area 17, but the leading edge of the coupon outwardly and partially projects from the outlet 23 for dispensation. When a player manually pulls the dispensed coupon from the outlet 23 in Step 66, the outlet sensor 24 is turned OFF and the processing moves to Step 67 "End".

In case of the coupon of stack double sheets in Step 61 or in case of the incorrectly printed coupon in Step 62, the stage comes to Step 68 where the issue control circuit 30 produces an output to the solenoid 43 to bring the clutch plate 40 into engagement with the drive gear 37 for coupled rotation. Also, simultaneously, the issue control circuit 30 furnishes the motor 21 with drive signals to rotate it in the forward direction in Step 69 so that the drive belt 46 runs to rotate the rollers 6 to 8, 10 and 11. Accordingly, the improper coupon in the stand-by area 16 is moved into the reject chamber 28 in Step 70. At the same time, the blank coupon which is forcibly stopped before the transport and idle rollers 6 and 9, is conveyed by the transport roller 6 to the printing area 15. Subsequently, the processing returns to Step 54 to repeat same operations in Steps 54 to 67 or if any to 70 and surely reissue another new coupon bearing the same indications or information.

Figure 10:
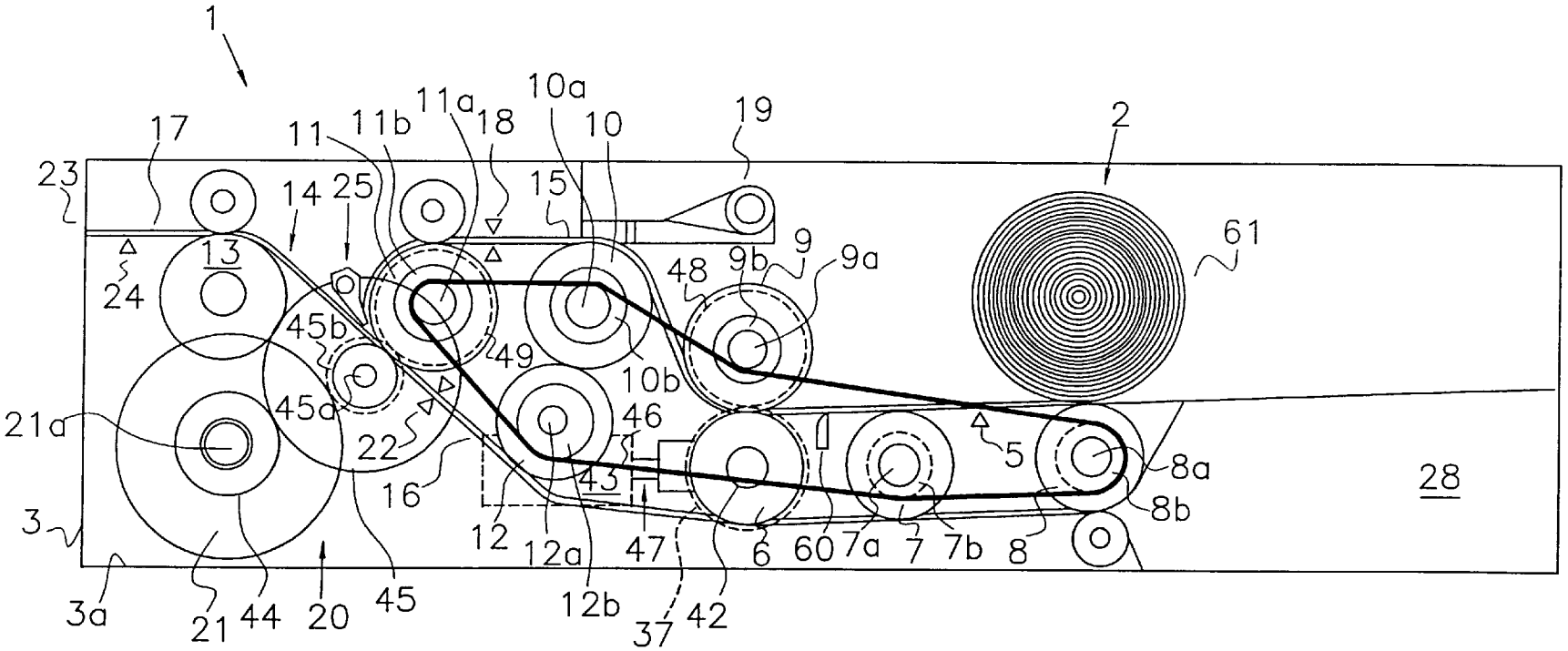
FIG. 10 is a cross-sectional view showing a second embodiment of the coupon issuing apparatus according to the present invention.

The present invention is not limited to the aforesaid embodiment which may be modified in various manners. For example, as shown in FIG. 10, a roll 61 of continuously wound paper may be used in lieu of separate blank coupons in the cassette 4. In this case, mounted in the printing area 15, preferably near the outlet of the cassette 4 is a cutter 60 operable by drive signals from the issue control circuit 30 which receives outputs of a rotary encoder not shown to cut the continuous paper of a roll 61 into card-like or sheet-like blank coupons with the given length. Accordingly, similar operations can be carried out to issue correct coupons utilizing cards or sheets cut by the cutter means 60. It should be understood that the roll 61 of continuous paper contains a plurality of potential blank coupons.

The embodiments of the present invention can show the following effects:

[1] The coupon issuing apparatus can dispense coupons indicative of monetary value corresponding to an amount of prize money that a player has gained for a gaming machine.

[2] Issuance of improper or invalid coupons can be prevented.

[3] Cashable coupons can promptly be issued each which represents a corresponding monetary value at player's request.

[4] Only a correct and single coupon can surely and easily be dispensed from the outlet to avoid trouble with a player.

[5] The gaming machine is free of storage or supply of bills.

[6] The coupon can be: dispensed with different monetary values every win game.

[7] The only one sheet of the proper coupon can be dispensed once for a player.

[8] The coupon issuing apparatus may be disposed in or around a gaming machine.

[9] The deflector is resiliently urged toward the rest position by the spring without any electric actuator.

[10] The gaming machine needs no dangerous work to carry bills or coupons to a gaming machine and fill the bill dispenser up with them.

[11] The printed proper coupon is easy to handle, carry and cash.

As mentioned above, the present invention is very advantageous in that a winner in the gaming machine has only a printed coupon to cash or continue gaming.

What is claimed is:

1. A coupon issuing apparatus for a gaming machine comprising:

a hopper having a cassette for containing a plurality of blank coupons;

a passageway having a printing area communicated with said hopper and a stand-by area communicated with said printing area for temporarily keeping the printed coupon;

a conveyor means for discharging a blank coupon from said hopper and transporting the blank coupon or printed coupon along said passageway for distribution from an outlet provided at the end of said passageway;

a printer provided in the vicinity of said printing area for printing gaming information on the moving blank coupon to produce a valuable coupon; and an issue control circuit for controlling operation of said conveyor means and said printer in response to an issue command of the gaming machine;

said conveyor means comprising pull rollers rotatably mounted under said cassette for drawing the blank coupon out of said cassette to said printing area and then conveying the coupon from said printing area to said stand-by area in cooperation with a plurality of drive rollers.

2. The coupon issuing apparatus of claim 1, further comprising:

a transducer disposed along said passageway at the downstream of said printer for converting the gaming information printed on the coupon into electrical signals and transmitting the signals to said issue control circuit, and a reject chamber connected to said passageway;

wherein said issue control circuit operates said conveyor means to forward the coupon to said reject chamber when said circuit decides the coupon as improper.

3. The coupon issuing apparatus of claim 2, wherein said passageway comprises a pay-out area communicated between said stand-by area and said outlet;

said stand-by area being communicated between said printing area and said reject chamber; and the apparatus further comprising a deflection device provided at a junction of said printing area and said pay-out area for movement between a rest position for closing said printing area and opening said pay-out area, and a shift position for opening said printing area and closing said pay-out area.

4. The coupon issuing apparatus of claim 3, wherein said deflection device comprises a deflector rotatably attached between the rest position and the shift position, and a return spring for resiliently urging said deflector toward the rest position;

wherein said deflector is rotated from the rest to the shift position against elastic force of said return spring by a leading edge of the coupon moving from said printing area to said stand-by area;

said deflector is retained in the shift position by elastic force of said return spring before and after the coupon is moved from said stand-by area to said pay-out area.

5. The coupon issuing apparatus of claim 1, wherein at least one of said pull rollers is in contact to a lowermost blank coupon in said cassette for drawing said lowermost blank coupon out of the cassette;

said conveyor means comprises a transport roller for transporting the blank coupon received from said pull roller to the printing area.

6. The coupon issuing apparatus of claim 5, further comprising an electromagnetic clutch device for stopping rotation of said transport roller to bar extraction of a next blank coupon from said hopper after the preceding blank coupon is transferred to the printing area.

7. The coupon issuing apparatus of claim 6, wherein said electromagnetic clutch device comprises a drive gear mounted on a clutch shaft for free rotation;

a clutch plate slideably mounted between the active and inactive positions on said clutch shaft for supporting said transport roller; and an actuator for urging said clutch plate in the inactive position to the active position to bring said clutch plate into detachable engagement with said drive gear.

8. The coupon issuing apparatus of claim 7, wherein said electromagnetic clutch device comprises a release spring for elastically urging said clutch plate toward the inactive position, and said actuator pushes said clutch plate toward the active position against the elastic force of said release spring.

9. A coupon issuing apparatus for a gaming machine comprising:

a hopper for containing a plurality of blank coupons;

a passageway that includes a printing area communicated with said hopper, a stand-by area communicated between said printing area for temporarily keeping the printed coupon, and a pay-out area communicated between said stand-by area and an outlet provided at the end of said passageway;

a conveyor means for discharging a blank coupon from said hopper and transporting the blank coupon or printed coupon along said passageway for distribution from said outlet;

a printer provided in the vicinity of said printing area for printing gaming information on the moving blank coupon to produce a valuable coupon;

a reject chamber connected to said passageway;

an issue control circuit for controlling operation of said conveyor means and said printer in response to an issue command of the gaming machine, said issue control circuit operating said conveyor means to forward the coupon to said reject chamber when said circuit decides the coupon as improper;

a transducer disposed along said passageway at the downstream of said printer for converting the gaming information printed on the coupon into electrical signals and transmitting the signals to said issue control circuit; and a deflection device provided at a junction of said printing area and said pay-out area for movement between a rest position for closing said printing area and opening said pay-out area, and a shift position for opening said printing area and closing said pay-out area, said deflection device comprising a deflector rotatably attached between the rest position and the shift position, and a return spring for resiliently urging said deflector toward the rest position; and wherein said deflector is rotated from the rest to the shift position against elastic force of said return spring by a leading edge of the coupon moving from said printing area to said stand-by area;

said deflector is retained in the shift position by elastic force of said return spring before and after the coupon is moved from said stand-by area to said pay-out area.

10. A coupon issuing apparatus for a gaming machine comprising:

a hopper having a cassette for containing a plurality of blank coupons;

a conveyor means for discharging a blank coupon from said hopper and transporting the blank coupon or printed coupon along a passageway for distribution from an outlet provided at the end of said passageway;

a printer provided in the vicinity of said passageway for printing gaming information on the moving blank coupon to produce a valuable coupon;

an issue control circuit for controlling operation of said conveyor means and said printer in response to an issue command of the gaming machine; and a reject chamber formed under said cassette in connection to said passageway.

* * * * *